United States Patent [19]

Eriksson

[11] Patent Number: 4,886,109

[45] Date of Patent: Dec. 12, 1989

[54] MOVABLE STRAND STIRRER

[75] Inventor: Jan E. Eriksson, Mörarp, Sweden

[73] Assignee: Asea Brown Boveri AB, Västerås, Sweden

[21] Appl. No.: 268,791

[22] Filed: Nov. 9, 1988

[30] Foreign Application Priority Data

Nov. 12, 1987 [SE] Sweden ..... 8704423

[51] Int. Cl.[4] ..... B22D 27/02

[52] U.S. Cl. ..... 164/504; 164/502

[58] Field of Search ..... 164/504, 468, 466, 502, 164/498, 499, 146, 147.1

[56] References Cited

U.S. PATENT DOCUMENTS 4,256,165 3/1981 Von Starck et al. ..... 164/504

4,749,026 6/1988 Metz et al. ..... 164/504

FOREIGN PATENT DOCUMENTS 2834305 2/1980 Fed. Rep. of Germany ..... 164/504

62-279060 12/1987 Japan ..... 164/504

63-252651 10/1988 Japan ..... 164/504

*Primary Examiner*—Richard K. Seidel

*Attorney, Agent, or Firm*—Watson, Cole, Grindle & Watson

[57] ABSTRACT

A device for stirring of the molten portion of a cast strand coming from a continuous casting machine, wherein at least one stirrer is placed at a cast strand in such a way that the stirrer does not surround the entire strand and such that the stirrer is movable away from the strand. A stationary core part is also arranged at the cast strand, which core part together with the stirrer, when this is in the operating position, completely or partially surrounds the cast strand.

2 Claims, 1 Drawing Sheet

MOVABLE STRAND STIRRER

TECHNICAL FIELD

The present invention relates to a two-phase or multiphase stirrer arranged at a cast strand, coming from a machine for continuous casting, for stirring the molten portion of the cast strand.

BACKGROUND ART

Stirring of the molten portion of a cast strand is performed in order to avoid segregations, the formation of cracks, the formation of voids, and the like, in the continuously cast product. To effect stirring of the molten portion of the strand, it is known to use a so-called round stirrer of motor stator type or a straight stirrer comprising one or more partial stirrers surrounding the cast strand (see, e.g., U.S. Pat. No. 4,183,395). A disadvantage of these types of stirrers is that they are fixedly mounted around the cast strand and therefore difficult to rapidly move in the case of an operational disturbance in the form of, for example, loss of water and breakthrough in the strand.

DISCLOSURE OF THE INVENTION

The invention aims to provide a device for solving the above-mentioned problems and other problems associated therewith. It is characterized in that the stirrer only partially surrounds the strand and that the stirrer is mounted in such a way as to be movable in relation to the strand. The displacement of the stirrer entails that the risk of damage to the stirrer in connection with interruptions of the service, for example loss of cooling water, breakthrough in the strand, is reduced. To enable repair and maintenance work close to the strand to be carried out in a more simple and rapid manner, the stirrer can be moved from the operating position at the cast strand to a position where it is possible, for example for tools and operating staff, to reach the cast strand and its surrounding parts such as the cooling device, tubes, backing rollers, and the like, of the continuous casting machine.

A stationary core part without a coil is also arranged close to the strand, which core part completely or partially fills up the space around the strand which is not occupied by the stirrer when this is in operating position. The stationary core part entails an improvement of the rotating magnetic field which produces the movement in the molten portion of the cast strand.

An additional advantage with a stirrer which does not completely surround the strand is that the device is adjustable to different sizes of the cast strand from, for example, billets (100××100 mm) to blooms (500×500 mm), since the stirrer has an open part which may be completely or partially filled up by a stationary iron core. The stationary iron core can also be supplemented with the addition of magnetically conductive material to fill up any gaps in those cases where the stationary core part partially fills up the open part of the stirrer.

DETAILED DESCRIPTION OF THE INVENTION

Figure 1:
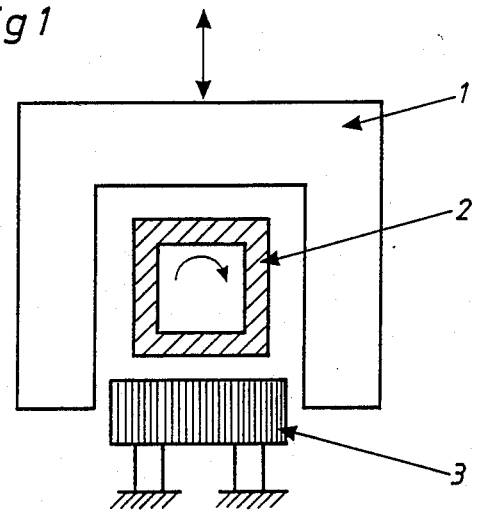
FIG. 1 is a side plan view of the stirrer surrounding the cast strand shown in section.
Figure 2:
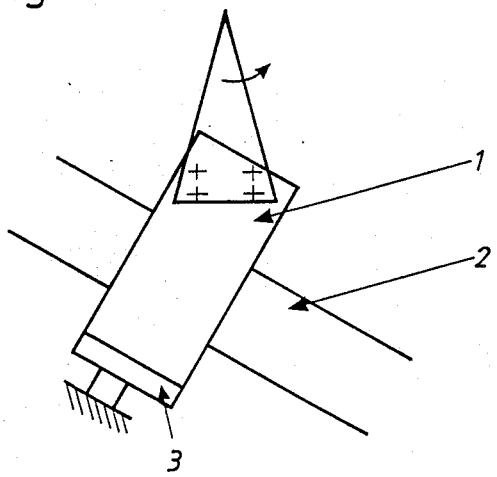
FIG. 2 is an end plan view of FIG. 1 and illustrating an example of a suspension for the stirrer.

FIG. 1 shows a cross section of the stirrer 1 comprising an iron core with 4–6 partial coils for two-phase or three-phase current supply. The stirrer 1 is designed so as to partially surround the cast strand 2. FIG. 1 shows how the stirrer 1 surrounds three sides of the strand 2. The cast strand 2 consists of a solidified shell and a molten inner portion, which is brought into motion by the action of a two-pole rotating magnetic field. Around the strand 2 is a framework consisting of, inter alia, tubes and backing rollers (not shown in the figure). A stationary core part 3 is mounted close to the strand 2 (FIGS. 1 and 2). The core part 3 may completely or partially fill up the space around the strand 2 which is not taken by the stirrer 1 when the stirrer is in the operating position.

FIG. 2 shows an example of a suspension of the stirrer 1, enabling the stirrer 1 to be moved away from the cast strand 2.

The device according to the above can be varied in many ways within the scope of the following claims.

I claim:

1. A device for stirring the molten portion of a cast strand coming from a continuous casting machine, comprising at least one two-phase or multiphase stirrer with a rotating magnetic field, said stirrer including a stationary iron core without winding separately mounted close to the strand, a movable iron core with a wound portion, and means for moving said iron core with the wound portion during the casting operation.

2. A device as in claim 1, wherein the movable iron core of said stirrer surrounds three sides of the cast strand.

* * * * *